US010407213B2

(12) United States Patent
Drossman

(10) Patent No.: US 10,407,213 B2
(45) Date of Patent: Sep. 10, 2019

(54) NESTED BOWL FOR PREVENTING LIQUID OVERFLOW

(71) Applicant: David S. Drossman, Spring Valley, NY (US)

(72) Inventor: David S. Drossman, Spring Valley, NY (US)

( * ) Notice: Subject to any disclaimer, the term of this patent is extended or adjusted under 35 U.S.C. 154(b) by 0 days.

(21) Appl. No.: 15/358,512

(22) Filed: Nov. 22, 2016

(65) Prior Publication Data

US 2018/0141713 A1 May 24, 2018

(51) Int. Cl.

| | |
|---|---|
| ***A47G 19/02*** | (2006.01) |
| ***B65D 25/02*** | (2006.01) |
| ***B65D 25/30*** | (2006.01) |
| *B65D 81/26* | (2006.01) |

(52) U.S. Cl.
CPC ..... *B65D 25/02* (2013.01); *B65D 25/30* (2013.01); *B65D 81/262* (2013.01)

(58) Field of Classification Search
CPC ..... A47G 19/12; A47G 19/02; A47G 19/027; A47G 19/00; B65D 25/04; B65D 25/02; A47J 42/50; A47K 1/04; A47K 1/06; A47K 3/02; A47K 3/022; A47K 3/024
See application file for complete search history.

(56) References Cited

U.S. PATENT DOCUMENTS

| | | | | |
|---|---|---|---|---|
| 1,963,261 A * | 6/1934 | Cuthbert | B43L 25/06 | 222/584 |
| 2,149,263 A * | 3/1939 | Ashmore | B43L 25/02 | 222/586 |
| 3,453,665 A * | 7/1969 | Alie | A47K 1/04 | 220/501 |
| 3,542,261 A * | 11/1970 | Greenberg | B44D 3/12 | 220/501 |
| 2013/0037540 A1* | 2/2013 | Sze | B65D 43/022 | 220/237 |

* cited by examiner

*Primary Examiner* — Stephen J Castellano
(74) *Attorney, Agent, or Firm* — Andrew Bochner

(57) ABSTRACT

The present invention provides a chambered bowl with a passageway between an inner bowl section and an outer bowl section. This allows for the liquid poured into the inner bowl to flow into the outer bowl and be trapped between the two, thereby eliminating the risk of spillage when moving the bowl.

10 Claims, 10 Drawing Sheets

NESTED BOWL FOR PREVENTING LIQUID OVERFLOW

FIELD OF THE INVENTION

Figure 1:
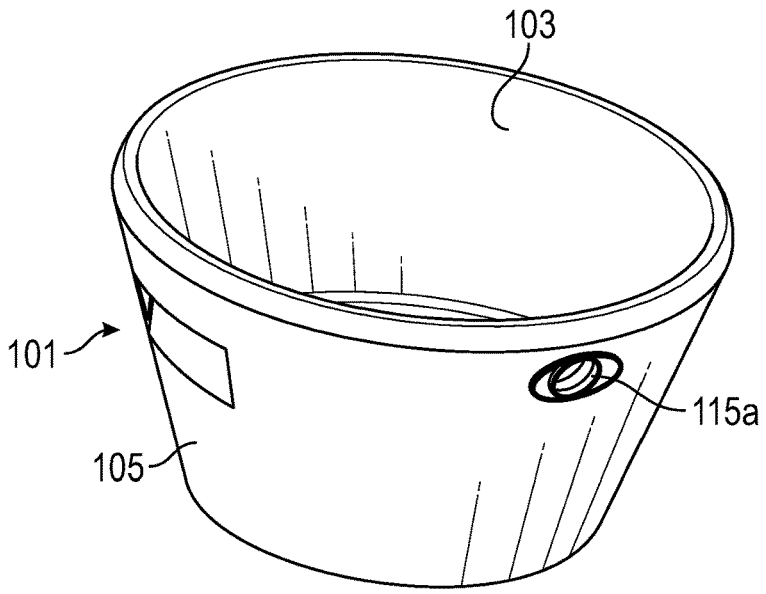

The present invention relates to a bowl. More particularly, the present invention pertains to a bowl for preventing overflow of contained liquid.

BACKGROUND OF THE INVENTION

Conventional bowls provide an efficient and convenient basin for holdings solids and liquids. Bowls are formed in a variety of shapes and sizes, but most frequently have a mouth opening, and rounded sides that narrow toward the bottom. The bottom is formed to allow the bowl to remain upright on a surface, and is usually flat or semi-flat.

Bowls are often utilized for serving food, including liquid-based food items, such as soup. However, bowls are often frequently employed for a variety of other uses, such as for display purposes, containers or basins (to hold a variety of articles) or other suitable purposes.

The bowl is a versatile article, and can be manufactured from almost any material, such as ceramic, glass, metal, plastic, or wood.

Although bowls are convenient and simple to use, their open-mouthed nature and lack of a built-in cover reduce the practical or desirable nature of the bowl for some purposes. In particular, when used to hold dangerous materials, such as chemicals, or hot foods, such as soup, the bowl must be transported with great care and effort, as there is an absence of a feature to prevent substances from falling over in the event the bowl is tipped.

In some instances, the bowl may be utilized as a washing bowl or basin. The bowl can thus be used to carry potable or fresh water, or may receive dirty or contaminated water. In an example, the bowl may be used to transport fresh water for cooking in a kitchen, while in another example, the bowl may include water that has been used to wash precious metals in a lab to remove contaminants, and thus may contain contaminated water.

The use of a bowl as a washing bowl or basin for holding water or liquids therefore provides for a mechanism for transporting water when away from a constant or manufactured source of flowing water. The water bowls can either contain an amount of water therein for the direct washing of the hands or can receive water poured from a container.

In another instance, the bowl may be used for ritual washing of hands or feet with clean water. Such washings often occur away from flowing sources of water. These bowls provide convenience by being highly portable, thereby allowing for use by multiple individuals.

Although such hand washing bowls and basins provide convenience by allowing for the transportation of the bowl for use by several individuals, these bowls, when filled to their expected capacity, are prone to spill when transported. That is, the benefit of a bowl as a transportable medium for carrying water is negated by its tendency to spill over, causing a spill that requires cleanup and resulting in a bowl that cannot carry the entirety of its contents.

Past efforts to contain spills from bowls include spill-proof containers having a nested construction, with bowl having an interior portion nested within an exterior larger bowl with bigger sidewalls, allowing for water to overflow from a first portion into a second portion of the bowl. These bowl/basin-types, however, fail to provide a direct communication between the first and second portions of the containers, and in the event of unforeseen movements, the water can exit over the container and spill onto a ground surface.

It would be desirable, therefore, to provide a bowl that reduces or eliminates the risk of spill, as well as associated damage and injury, that results from transporting or moving a bowl that is filled or partially filled.

It would be further desirable to provide the aforementioned benefits by providing a chamber within the bowl itself, eliminating the need for a cover and reducing the risk of spills.

SUMMARY OF THE INVENTION

The present invention provides a chambered bowl with a passageway between an inner bowl section and an outer bowl section. This allows for the liquid poured into the inner bowl to flow into the outer bowl and be trapped between the two, thereby eliminating the risk of spillage when moving the bowl.

BRIEF DESCRIPTIONS OF THE DRAWINGS

The subject matter regarded as the invention is particularly pointed out and distinctly claimed in the claims at the conclusion of the specification. The foregoing and other objects, features, and advantages will be apparent from the following detailed description, taken in connection with the accompanying drawings.

FIG. 1 displays a view of the present invention.

Figure 2:
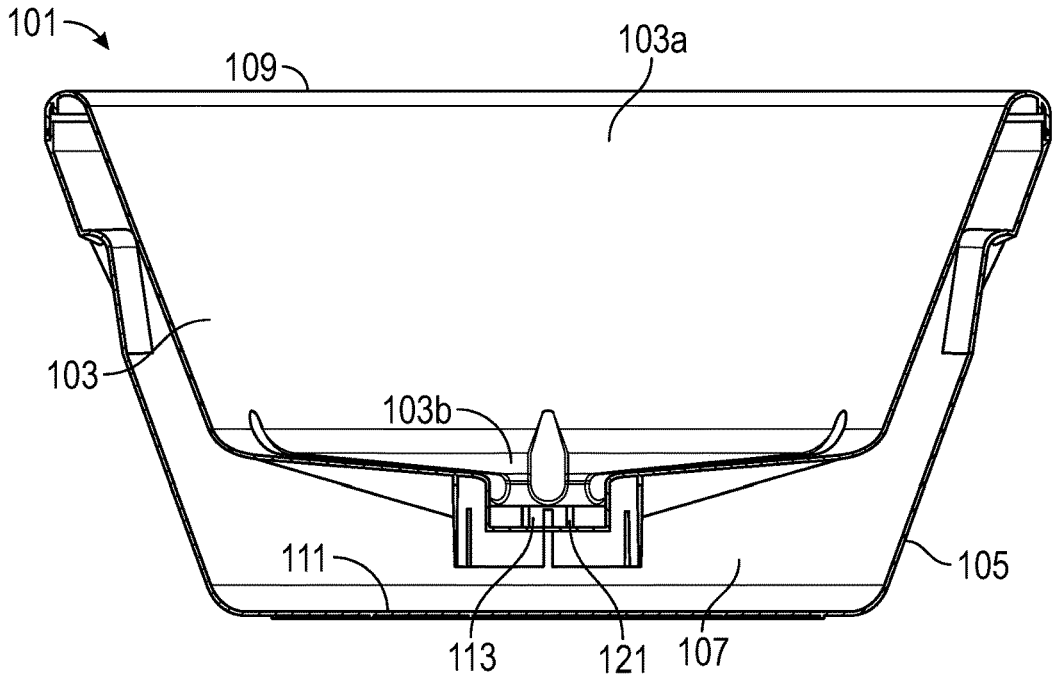

FIG. 2 displays a cross-sectional view of the present invention.

Figure 3A:
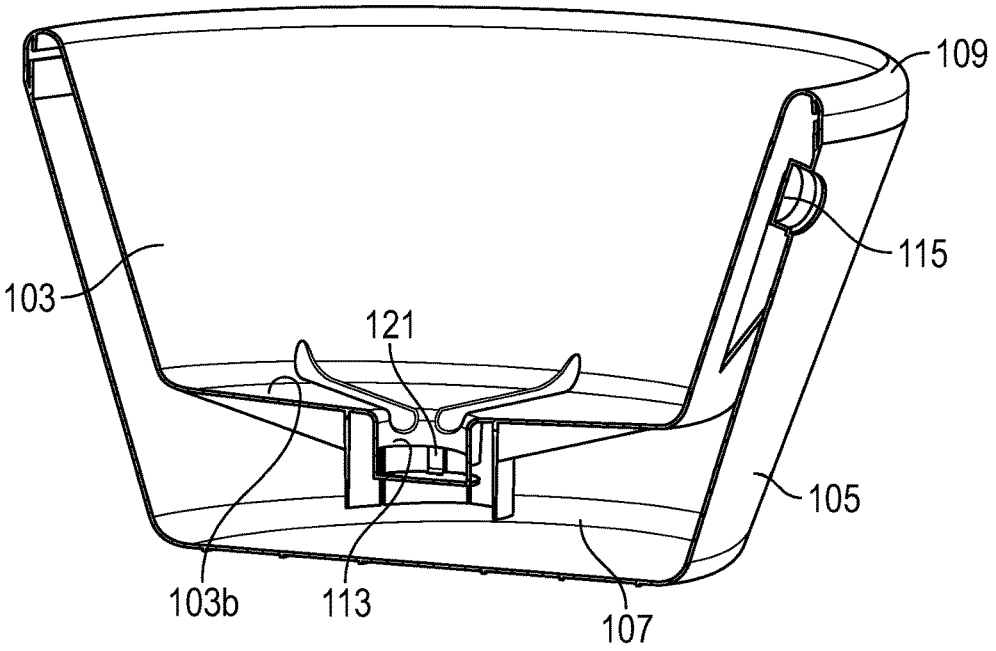
Figure 3B:
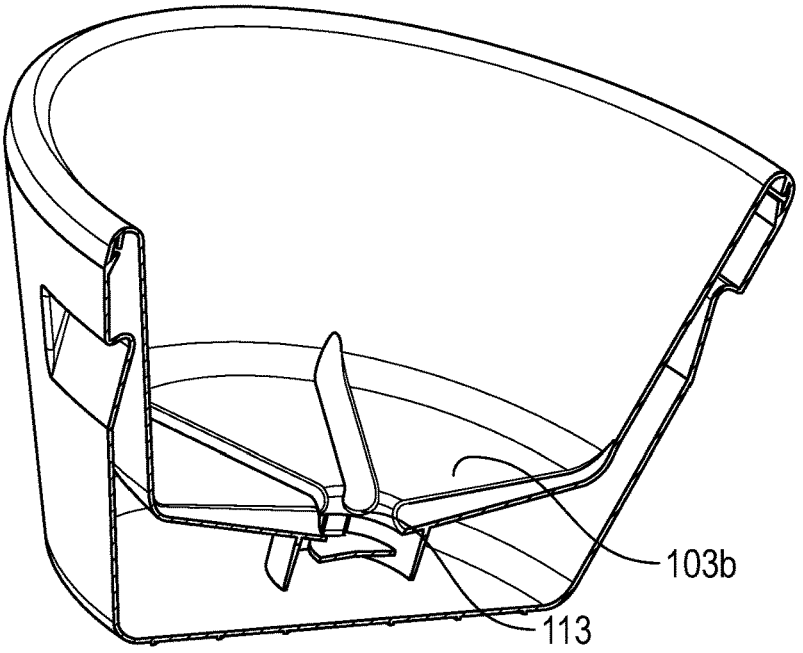

FIGS. 3A-3B display perspective, cross-sectional views of the present invention.

Figure 4A:
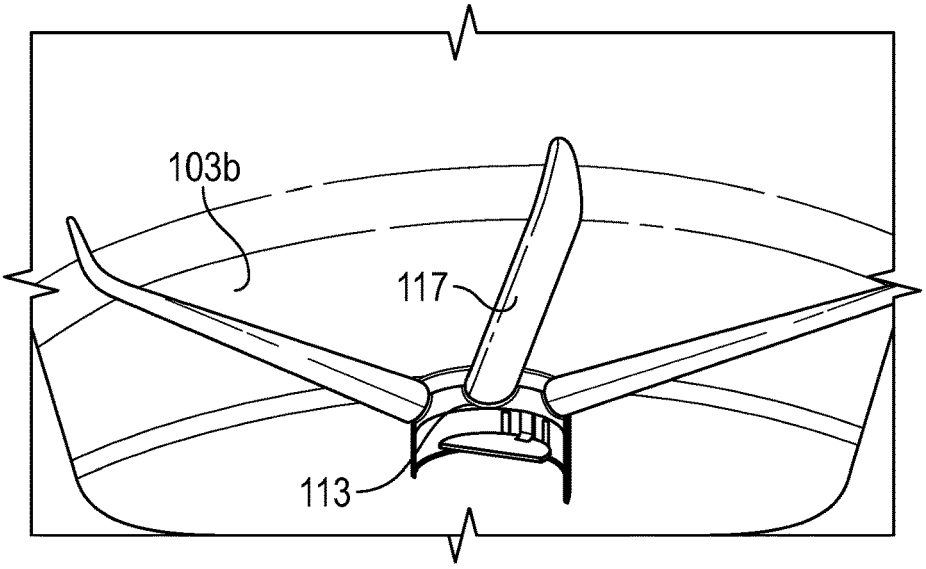
Figure 4B:
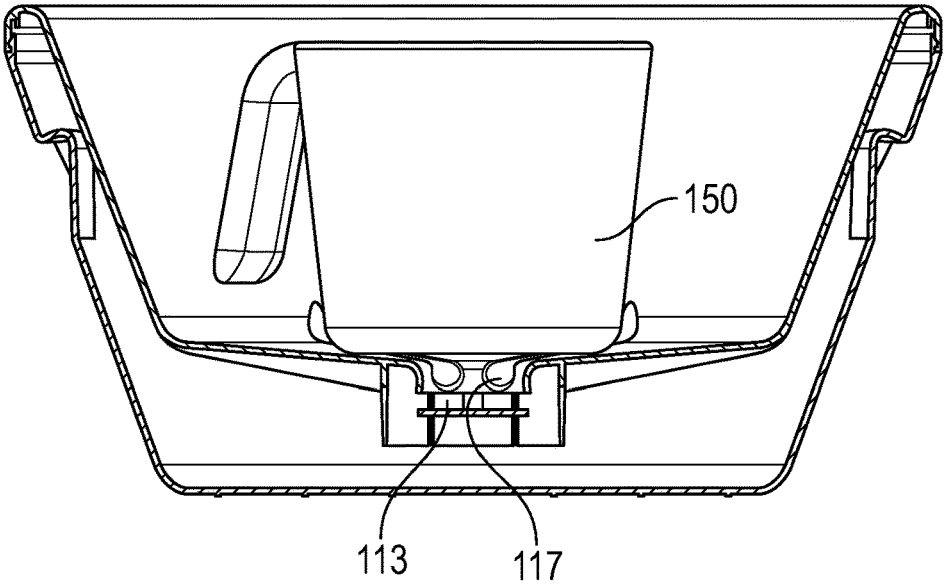

FIGS. 4A-4B display additional cross-sectional views of the present invention.

Figure 5A:
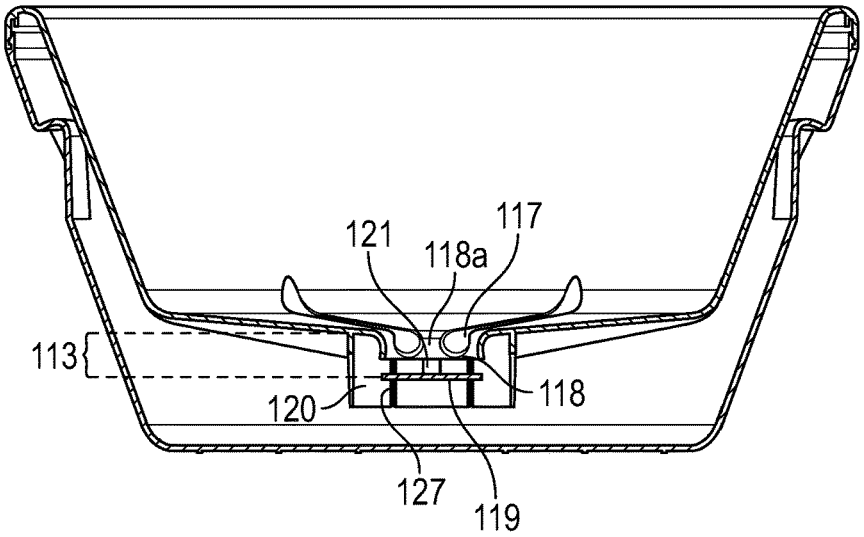
Figure 5B:
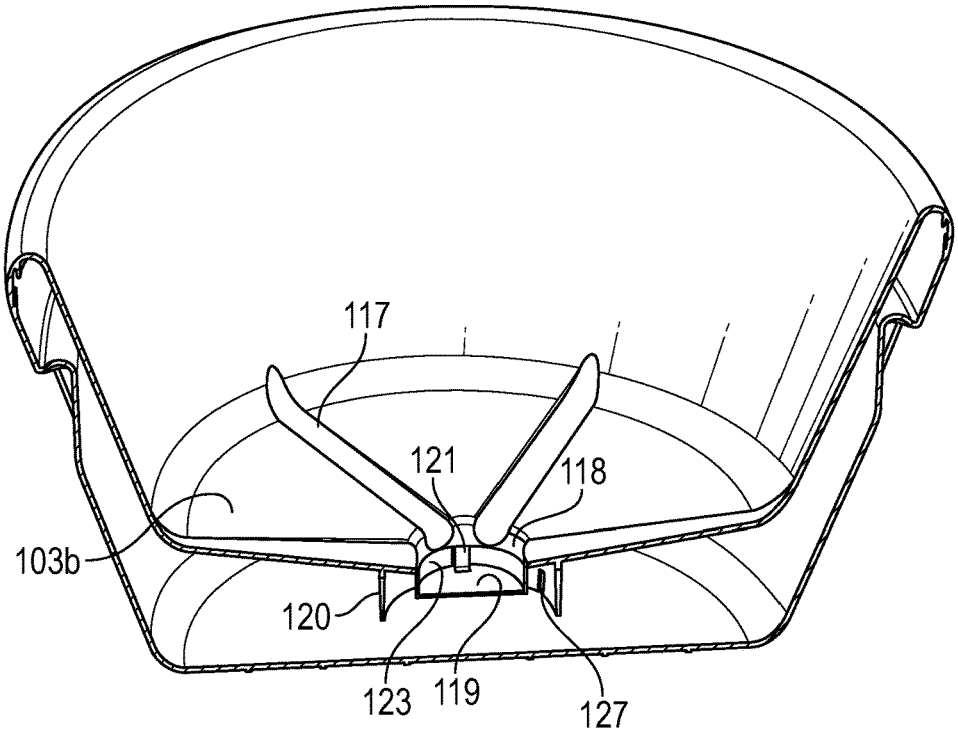
Figure 5C:
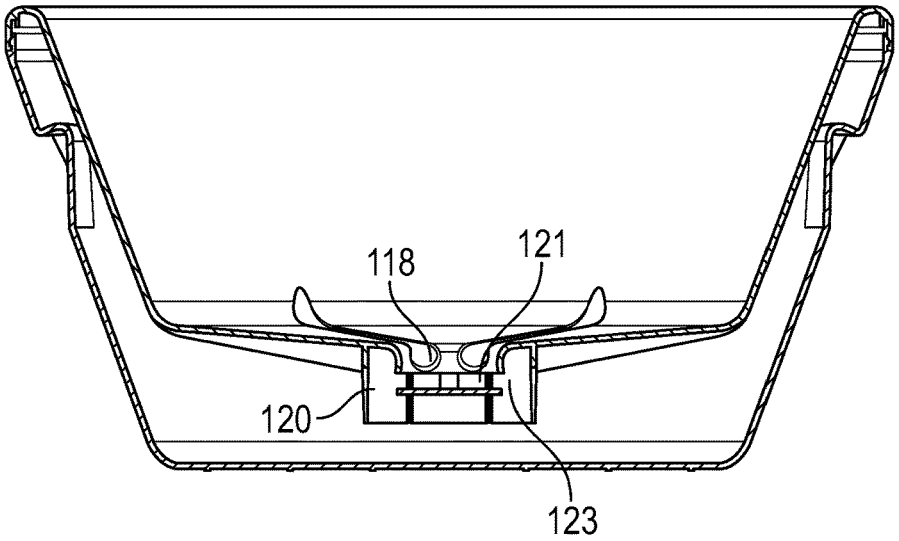

FIGS. 5A-5C display yet additional cross-sectional views of the present invention.

Figure 5D:
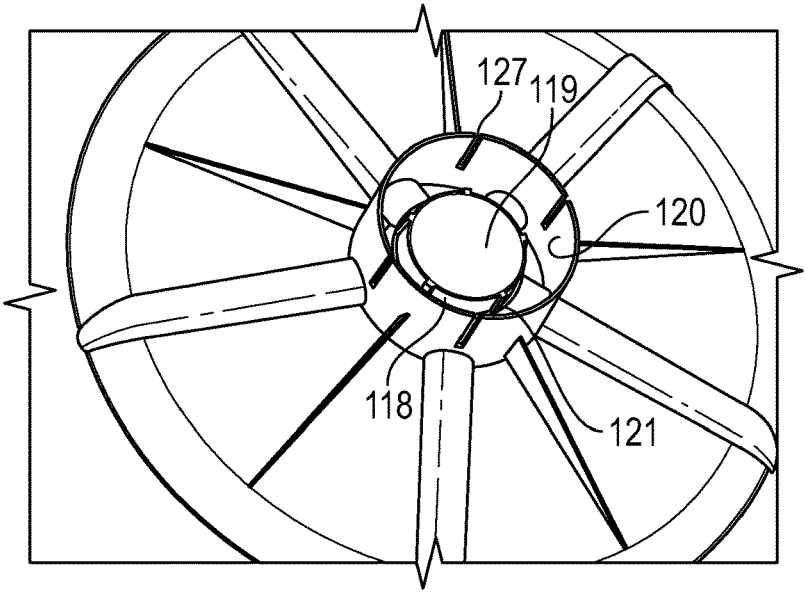

FIG. 5D displays an inverted view of the present invention.

Figure 6A:
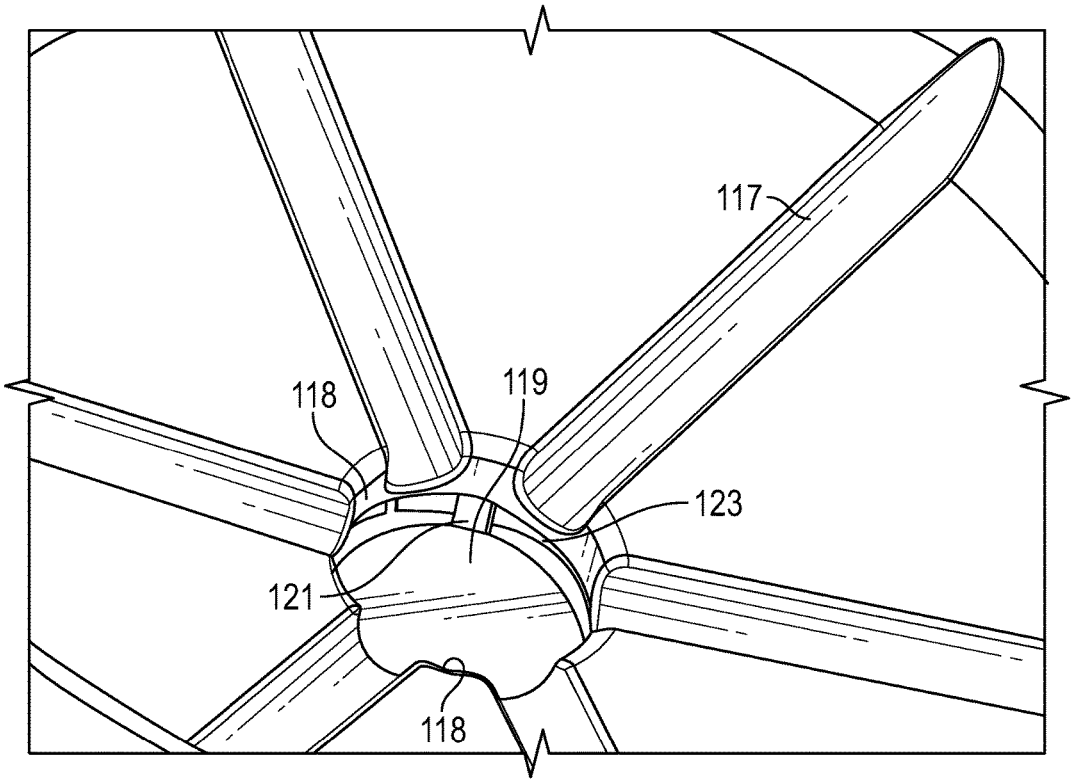
Figure 6B:
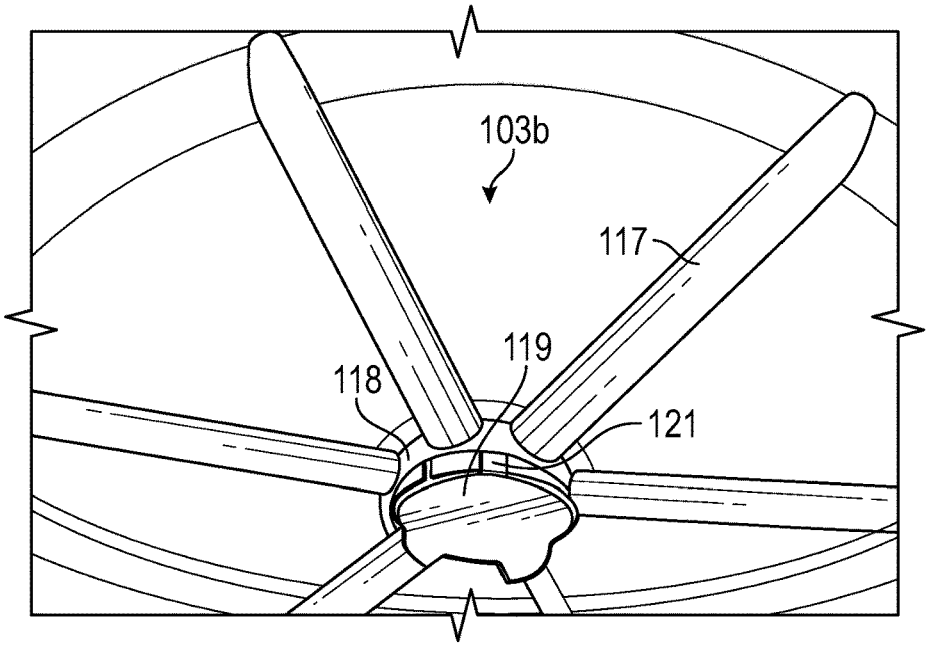
Figure 6C:
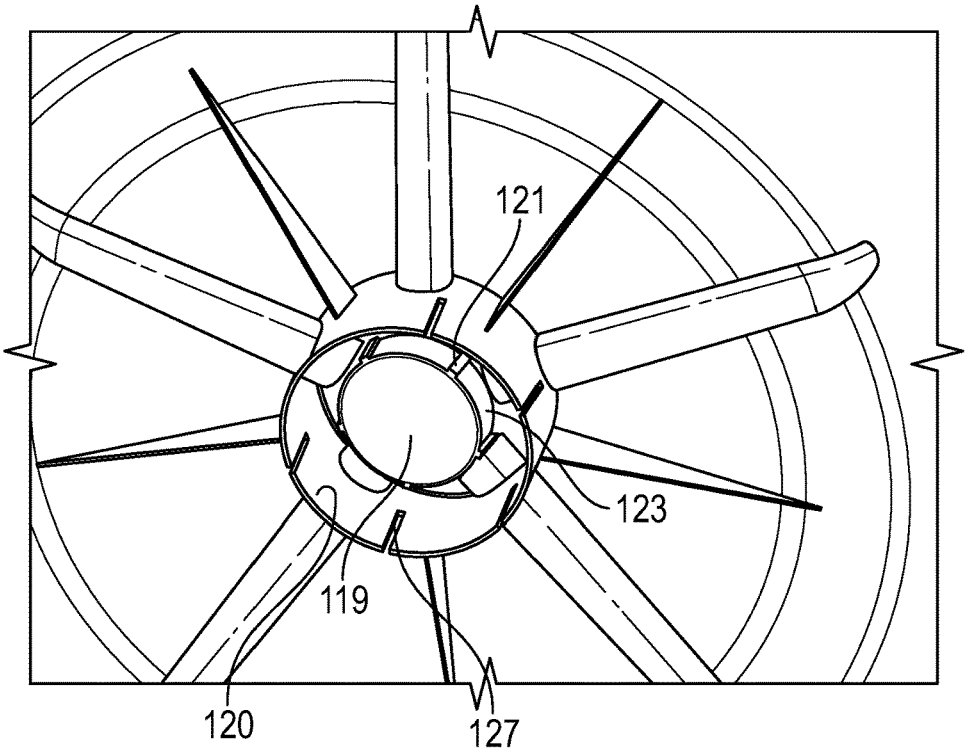

FIGS. 6A-6C display additional views of an exemplary embodiment of the present invention.

Figure 6D:
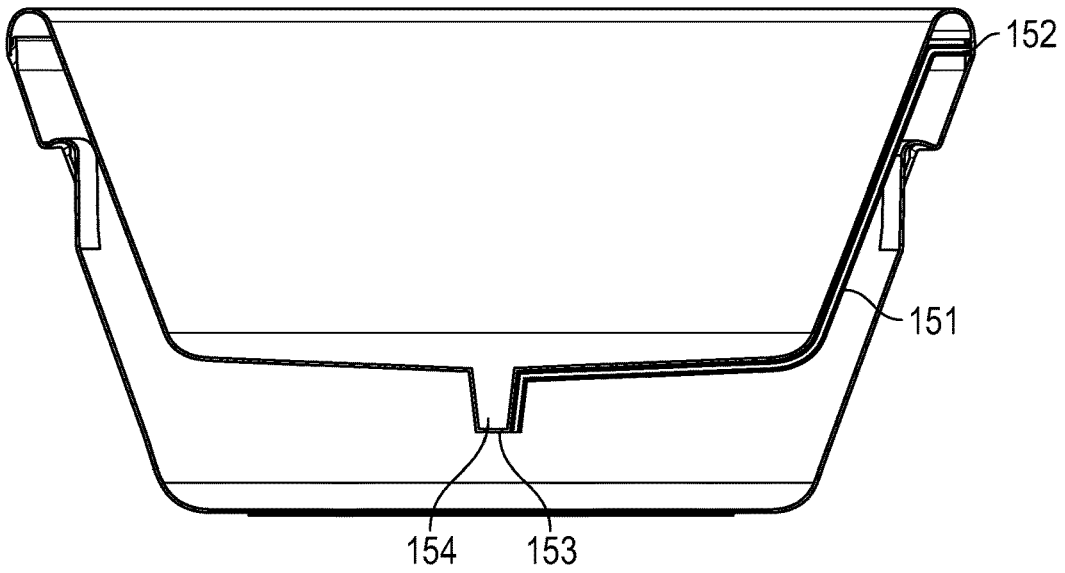
Figure 6E:
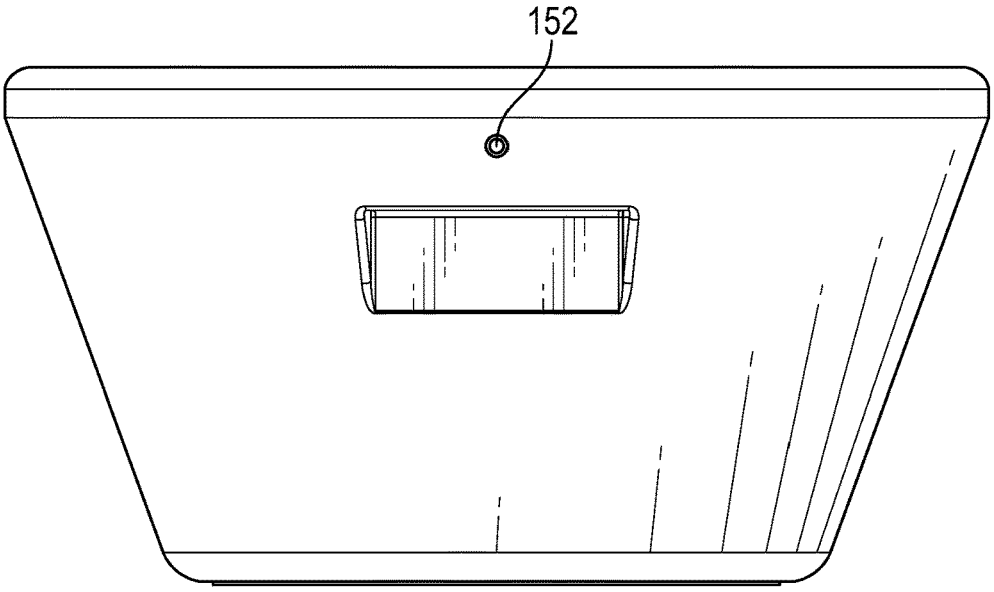

FIGS. 6D-6E display another exemplary embodiment of the invention.

Figure 7:
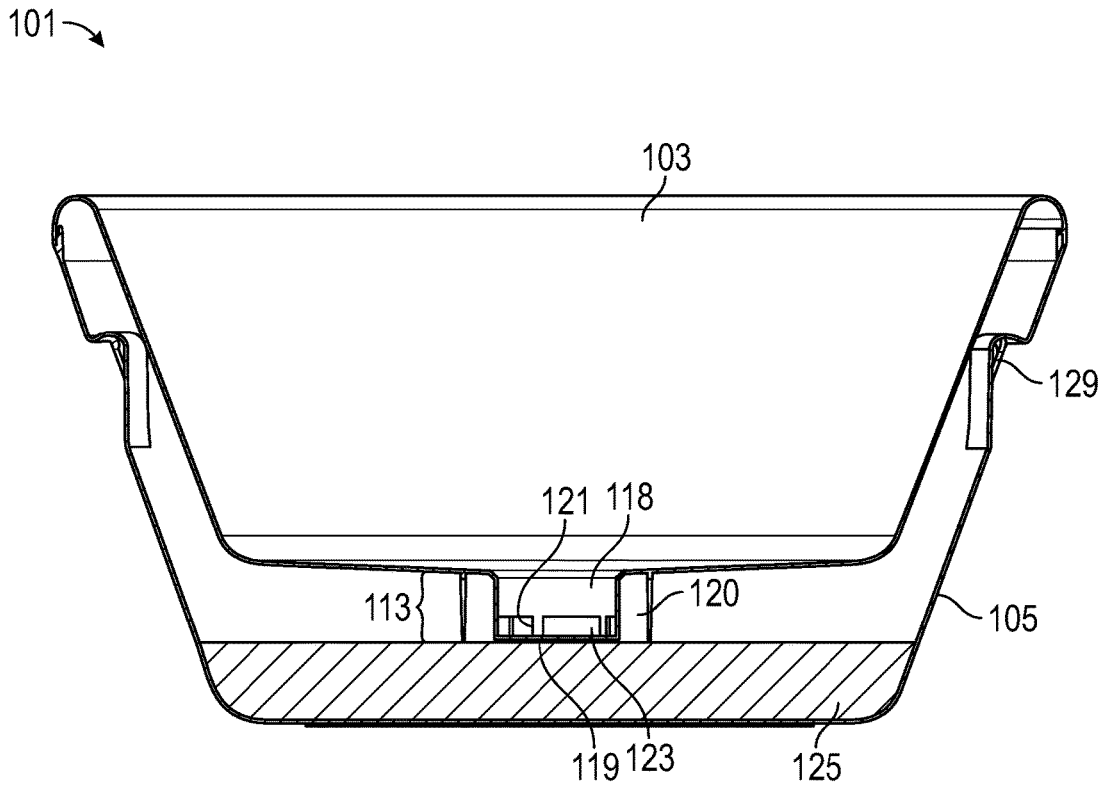

FIG. 7 displays a cross-sectional view of the invention.

Figure 8A:
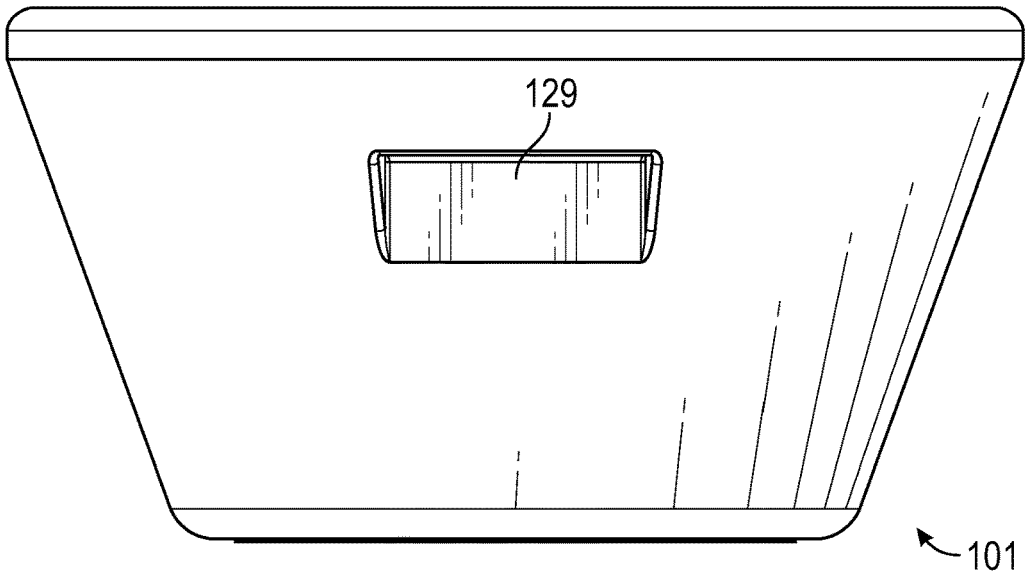
Figure 8B:
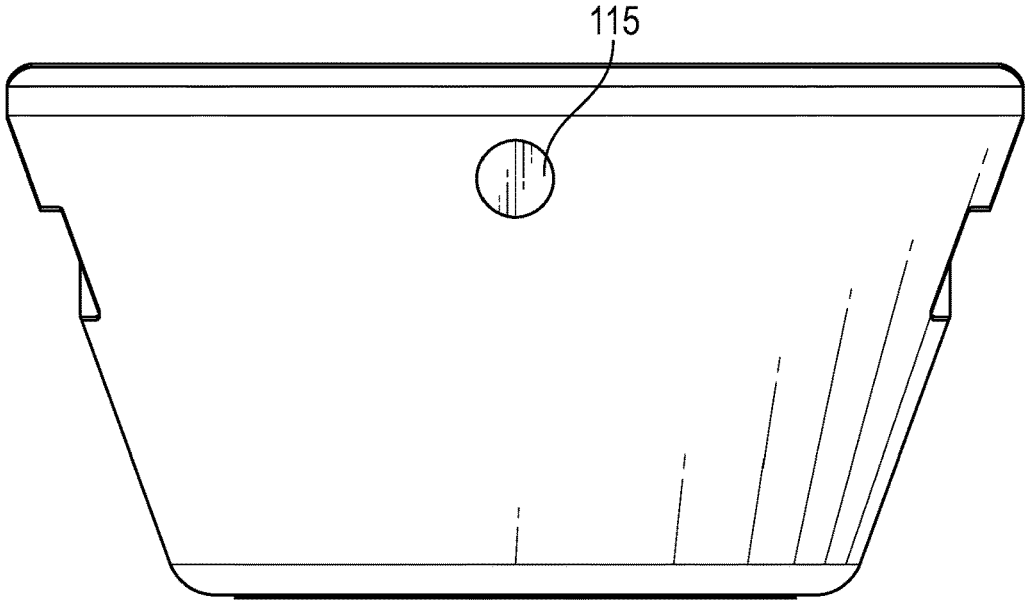

FIGS. 8A-8B display additional embodiments of the invention.

DETAILED DESCRIPTION OF THE INVENTION

Referring now to FIG. 1, displayed is an exemplary view of the present invention. The present invention provides a bowl or basin (hereinafter referred to as a "bowl") for holding a liquid or viscous substance. The inventive bowl 101 offers many benefits over standard bowls by eliminating the risk of spillage that results from movement of the bowl. That is, in accordance with the invention, the inventive bowl 101 solves the problem of movement of fluids within the bowl, which would otherwise result in the fluid spilling over the side of the bowl.

In accordance with the invention, the bowl 101 is a chambered bowl, formed of an inner bowl section 103 and outer bowl section 105. The inner and outer bowl sections may be formed from singular construction, as one piece, or may be separately formed and attached to one another.

Referring now to FIG. 2, illustrated is a cross-sectional view of the bowl 101. Between the inner bowl section 103 and outer bowl section 105 is an enclosed space 107, which is formed to receive a fluid. The top portion of enclosed space 107 is formed from the bottom 103*b* of inner bowl section 103, while the bottom portion of enclosed space 107 is formed from the interior bottom 111 of outer bowl section 105. The space between the inner and outer sections is fully enclosed, such that no fluids leak out of the enclosed space.

The bowl 101 is formed such that, upon pouring fluid into the interior of the bowl (i.e., into inner bowl section 103), the fluid flows into the inner section 103 and through to enclosed space 107.

Bowl 101 includes a central opening 113 formed between the inner section 103 and the outer section 105. Central opening 113 is formed as a hole through the bottom portion 103*b* of inner section 103, and facilitates the flow of fluid from the inner section 103 into the space 107, located between inner section 103 and outer section 105.

The central opening 113 is formed such that fluid is trapped within the device, redirecting the fluid from continuing up the sidewall 103*a* of the inner bowl section 103, where it would otherwise spill over the edge 109 of the bowl 101. That is, in accordance with the invention, the central opening 113 redirects fluids from flowing over the edge 109 of the bowl 101, and traps it within the bowl, between the two sections. Thus, during a subsequent movement of the bowl 101, liquid in motion does not move up the sidewall 103*a* and over the edge 109 of the bowl, but instead, the liquid has already moved out the bottom portion 103*b* through central opening 113 and into enclosed space 107, where it is now trapped.

In one embodiment, the central opening 113 is formed as a hole within the floor, e.g., the bottom portion 103*b*, of the inner section 103. That is, the central opening 113 is similar to a drain to allow liquid to flow through an opening in the floor. In another embodiment, central opening 113 is formed as a plurality of holes, or a gap or vent, between the inner section 103 and outer section 105.

Referring back to FIG. 1, in order to facilitate easy removal of fluid trapped within the space 107 between inner section 103 and outer section 105, from within the enclosed space, the inventive bowl further includes one or more side openings 115. The side openings 115 include a removable mechanism 115*a* for opening and closing the side opening, such as a plug, stop, seal, or threaded cap or screwcap, or any other suitable device. This allows for fluids to be released externally, directly from the outer bowl section 105, and be poured out, instead of being required to flow back through the central opening 113 into the inner bowl section 103.

Referring now to FIG. 3A, displayed is another cross-sectional view of the inventive bowl 101. Illustrated is the chambered bowl 101 formed of a nested, singular or multiple-piece construction, with a hollow interior space 107 defining an outer bowl section 105 and the inner bowl section 103. The outer bowl section 105 resembles a traditional bowl, however, the edge 109 of the bowl 101 curves downward and inward, and thereafter forms the inner bowl section 103, thereby providing the singular construction of the present invention.

As illustrated in FIG. 3A, central opening 113 forms an opening in the bottom portion 103*b* of the inner bowl section 103. In FIG. 3B, a side profile cross-sectional view of the inner bowl section 103 illustrates that central opening 113 is formed as an opening in the bottom portion 103*b*. Central opening 113 is shown as configured to receive fluid flowing down from channels 117.

FIG. 4A illustrates a close-up cross-sectional view of the central opening 113 in accordance with the invention. Central opening 113 is formed from the bottom portion 103*b* of inner bowl section 103. In the embodiment illustrated, bottom portion 103*b* includes one or more channels 117, which may be sloped at a downward angle toward the central opening 113. Channels 117 facilitate the flow of fluid toward the central opening 113.

In one embodiment, a cup 150 or blockage, shown in a cross-sectional view in FIG. 4B, may be placed over the central opening 113. Channel 117 facilitates the flow of fluids toward central opening 113, and flows underneath the cup 150 or blockage placed on top of central opening 113, and directly into the sidewall of central opening 113.

Referring to FIGS. 5A-5D, central opening 113 is formed of, and includes, a pair of tubes 118, 120 extending downward from inner bowl section 103 toward outer bowl section 105. The tubes are made up of inner tube 118 and outer tube 120. Tube 118 is formed as a barrier to prevent backflow of liquid into the central opening 113 and back into inner bowl section 103, and also functions as a drainage tube. Tube 120 is a barrier that prevents backflow of liquid.

FIG. 5A illustrates a cross-sectional view of central opening 113 with inner tube 118 and outer tube 120. FIG. 5B illustrates a perspective cross-sectional view of central opening 113 with inner tube 118 and outer tube 120. FIG. 5C illustrates a schematic cross-sectional view of central opening 113 with inner tube 118 and outer tube 120. FIG. 5D illustrates an inverted view (upside down) of inner bowl section 103, with the central opening 113, illustrating the outer tube 120, as well as a view of a portion of inner tube 118 through a series of slots.

As illustrated with reference to FIGS. 5A-5B, inner bowl section 103 includes an enlarged opening, and is in fluid communication with outer tube 120 via inner tube 118. Outer tube 120 includes one or more elongated slits 127 formed in the sidewall, which provides for airflow. The airflow is provided into the central opening 113, which prevents a backup of fluid in the opening 113. The elongated slits 127 along the outer tube 120 are uniquely formed so that the length of tube 120 does not interfere with fluid draining, and to further prevent splash-back of fluid.

Central opening 113 includes a recessed platform 119. Recessed platform is sunken relative to the top of the opening, which is roughly on the same plane as the bottom portion 103*b*. That is, recessed platform 119 is formed lower than bottom portion 103*b*, and is suspended from the inner bowl section 103, within space 107. The suspension of recessed platform 119 is facilitated by one or more brackets 121. Brackets 121 are attached at the other end to sidewall 118*a* of inner tube 118, as shown in FIG. 5A.

Illustrated in FIGS. 6A-6C are close-up views of central opening 113 and inner tube 118. Brackets 121 are formed at intervals around the circumference of recessed platform 119, and define a series of slots 123. Slots 123 provide a distributed flow system for liquids to flow through the central opening 113 and into the space 107 above outer bowl section 105.

Referring now to FIG. 7, illustrated is a cross-sectional view of the inventive bowl 101 with fluid 125 residing within the interior of outer bowl section 105. In one embodiment, one liter of fluid may reside within space 107, without spilling out from the bowl 101. Central opening 113 provides a throughway between inner bowl section 103 and outer bowl section 105, wherein the throughway includes a pair of tubes 118, 120. The inner tube 118 is shown with a series of elongate slots 123 which allow for airflow.

Outer tube 120 therefore functions as a barrier to keep drained fluid away from central opening 113, by preventing the fluid from splashing back into the inner bowl section 103. The outer tube 120 may thus be formed of varying lengths, as the increase in length increases the barrier against fluid splash-back. In accordance with the invention, as fluid is poured into the bowl 101, proceeding into the inner bowl section 103 and then into the outer bowl section 105, the fluid begins to rise within the outer bowl section, as illustrated by the fluid 125 in FIG. 7. As the height of the fluid proceeds to reach the bottom of tube 120, an airtight seal would normally form, preventing further fluid from draining from inner bowl section 103 into outer bowl section 105. However, the presence of elongated slits 127 in outer tube 120, shown, for example in FIG. 5D, eliminates formation of the seal, and allows for continued draining from inner bowl section 103 into outer bowl section 105. Thus, it prevents belching resulting from rising air bubbles that would otherwise occur due to pressure buildup.

In accordance with the invention, inner tube 118 lies within outer tube 120, and is of a shorter length than outer tube 120. In one embodiment, inner tube 118 is about an inch in length, although any other length is suitable and is contemplated by the invention. In addition to a barrier formed by outer tube 120, the sidewall of inner tube 118 further prevents fluid from traveling back through central opening 113 when the bowl 101 is placed sideways or upside down.

Platform 119 may be a circular plate, and acts as a barrier to prevent upward traveling of fluid through tube 118 and back into central opening 113. As shown, platform 119 is connected through a series of brackets or prongs 121, to inner tube 118. In one embodiment, the length of inner tube 118 does not extend concurrently with the length of the outer tube 120 for the entire length. That is, by being shorter, tube 118 does not interfere with the functionality of slits 127 of the outer tube 120.

Referring now to FIGS. 6D-6E, illustrated is another embodiment of a centralized opening, referred to as central drainage tube 154. Drainage tube 154 is a narrow, funnel-type opening, and does not use a recessed plate or slots. In this embodiment, air vent channel 151 facilitates airflow between the funnel opening and the liquid as it flows between the inner and outer bowl sections 103 and 105, respectively.

In this embodiment, the air vent channel 151 is attached to the underside of inner bowl section 103, beginning at the highest point of the inner bowl and extending outward to a point in the outer bowl 105's surface. The channel then opens as an unplugged hole 152 on the side of outer bowl 105.

The channel 151 extends inward and downward from the hole 152, along the underside of inner bowl section 103, toward the centrally located funnel tube opening 153 of the inner bowl 103. The channel 151 ends at a depth of, and alongside of and attached to, the funnel opening 153.

In order to remove the water from within the chambered bowl, a drainage mechanism is provided. The drainage mechanism includes side hole 115, or a plurality of holes, and plug 115*a*. The hole 115 is plugged when the device is filled with liquid and can be unplugged in order to allow drainage from between the nested construction when needed. Further, the present invention includes a pair of indented side handles 129, as shown in FIG. 7. The side handles 129 are incorporated into the exterior portion of the outer bowl section 105, in order to aid in the transportation of the hand washing bowl of the present invention. Alternatively, external side handles may be used.

FIG. 8A illustrates an exemplary view of the bowl 101 with side handle 129. This may be used with any of the disclosed embodiments.

FIG. 8B illustrates an exemplary view of side hole 115 without a plug. Referring back to FIG. 1, illustrated is a view of side hole 115 with plug 115*a* placed over the side hole.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

What is claimed is:

1. A bowl comprising:

an inner bowl section;

an outer bowl section, the inner bowl section nested within the outer bowl section, the inner and outer bowl section forming an enclosed space, said enclosed space adapted for receiving fluid, a top wall of said enclosed space formed from a bottom of the inner bowl section and a bottom wall of said enclosed space formed from an interior bottom of the outer bowl section;

a central opening, the central opening forming an aperture extending through the bottom portion of the inner bowl section and into the enclosed space, such that the central opening terminates before the outer bowl section;

a recessed platform formed within the central opening, the recessed platform being sunken relative to the bottom of the inner bowl section and being suspended within the enclosed space; and a side hole with a removable plug, wherein the central opening includes an inner tube and an outer tube extending downward from the central opening.

2. The bowl of claim 1, the outer bowl section further including at least one side handle.

3. The bowl of claim 1, wherein the inner tube includes a plurality of elongated slots.

4. The bowl of claim 1, wherein the outer tube includes a plurality of slits.

5. The bowl of claim 1, wherein the inner bowl section includes at least one channel descending at a downward angle toward the central opening.

6. The bowl of claim 1, wherein the bottom portion of the inner bowl section further comprises a plurality of channels.

7. The bowl of claim 6, wherein the plurality of channels are sloped at a downward angle toward the central opening.

8. The bowl of claim 7, wherein the plurality of channels are recessed within the bottom portion of the inner bowl section, such that, when an object is placed upon the bottom portion, fluid is adapted to flow within the channels, underneath the object.

9. The bowl of claim 1, wherein the inner tube is concentrically formed within the outer tube, the inner and outer tubes formed to prevent backflow of liquid into the central opening.

10. The bowl of claim 9, wherein the outer tube includes at least one elongated slit formed in a sidewall of the outer tube, said elongated slit providing airflow to prevent fluid backup.

* * * * *